US006278372B1

(12) United States Patent
Velasco, Jr. et al.

(10) Patent No.: US 6,278,372 B1
(45) Date of Patent: Aug. 21, 2001

(54) METHODS AND APPARATUS FOR PROMOTING HYGIENE

(75) Inventors: Pastor Velasco, Jr., Stillwater; Tina O. Outlaw, Inver Grove Heights, both of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/585,489

(22) Filed: Jun. 1, 2000

(51) Int. Cl.[7] ..... G08B 23/00

(52) U.S. Cl. ..... 340/573.1; 340/309.15; 340/331; 340/691.5

(58) Field of Search ..... 340/573.1, 309.15, 340/331, 332, 691.4, 691.5

(56) References Cited

U.S. PATENT DOCUMENTS

| | | | | |
|---|---|---|---|---|
| 4,492,479 | | 1/1985 | Hatsuse et al. | 368/109 |
| 4,606,085 | * | 8/1986 | Davies | 4/623 |
| 4,785,433 | | 11/1988 | Bush et al. | 368/109 |
| 5,202,666 | | 4/1993 | Knippscheer | 340/573.1 |
| 5,438,555 | | 8/1995 | Kim | 368/10 |
| 5,610,589 | | 3/1997 | Evans et al. | 340/537.1 |
| 5,670,945 | | 9/1997 | Applonie | 340/573.1 |
| 5,771,925 | * | 6/1998 | Lewandowski | 137/552.7 |
| 5,812,059 | * | 9/1998 | Shaw et al. | 340/573.1 |
| 5,854,774 | | 12/1998 | Timme | 368/10 |
| 5,945,068 | * | 8/1999 | Ferone | 422/28 |
| 5,947,369 | * | 9/1999 | Frommer et al. | 235/382 |
| 5,952,924 | * | 9/1999 | Evans et al. | 340/573.1 |

FOREIGN PATENT DOCUMENTS

| | | | |
|---|---|---|---|
| 196 23 077 | * | 10/1997 | (DE) . |
| 2 324 397 | * | 10/1998 | (GB) . |

* cited by examiner

*Primary Examiner*—Thomas Mullen
(74) *Attorney, Agent, or Firm*—Mau & Krull, P.A.

(57) ABSTRACT

A badge emits light to signal that the person wearing the badge has clean hands. The light is discontinued after a period of time to indicate that the person should proceed to wash his/her hands. The badge may emit light in a distinct manner (or generate sound) during a time period in which the person is supposed to be washing his/her hands. This distinct signal would be generated in response to user input, which should be entered only when the person wearing the button is beginning to wash his/her hands.

20 Claims, 3 Drawing Sheets

METHODS AND APPARATUS FOR PROMOTING HYGIENE

FIELD OF THE INVENTION

The present invention relates to the promotion of hygiene and more specifically, to a signaling device worn by a person and operable to signal when the person should wash his/her hands.

BACKGROUND OF THE INVENTION

In various situations, it is considered desirable to remind and/or encourage people to perform certain tasks at prescribed times or intervals of time. For example, workers in the food preparation industry are encouraged to wash their hands regularly in order to minimize transmission of harmful organisms and/or substances. As a result, systems have been developed to encourage and/or monitor employee participation in hygiene awareness programs. In one known system, each employee wears a badge which is programmed to emit a light and/or a sound at the end of a predetermined interval of time, indicating that the employee should presently wash his/her hands. One problem with this particular system is that the signal may be viewed negatively by both the employee wearing the badge and any consumers or patrons in proximity to the employee. In other words, the sudden presence of a signal is like a red flag, which may tend to embarrass the employee and/or pique the curiosity of patrons. Moreover, if the badge simply generates a signal and then reverts to its less conspicuous state, either automatically or in response to employee input, then there is no guarantee that the employee proceeded to wash his/her hands in response to the signal. In view of the foregoing, room for improvement remains with regard to the promotion of hygiene in food preparation settings and other appropriate environments.

SUMMARY OF THE INVENTION

One aspect of the present invention is to provide a badge that is worn by a person and includes a light emitting element which is deactivated to signal when the person should wash his/her hands. An advantage of this arrangement is that the presence of light, which is relatively more noticeable than the absence of light, is associated with a positive state of affairs, namely, clean hands. Recognizing that a consumer is much more likely to inquire about the badge when it is lit, the present invention facilitates a more comfortable and positive response from the person wearing the badge.

Another aspect of the present invention is to provide a badge that is worn by a person and includes a signaling device which is activated by the person to generate a unique signal during a time period in which the person should be washing his/her hands. An advantage of this arrangement is that this unique signal should be visible only when the person has moved to a wash area and begun washing his/her hands. Because the person controls the activation of the signaling device, it will not unexpectedly generate the signal during a potentially awkward moment.

The foregoing features may be combined in one device having a light emitting element, which displays light in a first manner to indicate that the person wearing the badge has clean hands, and which displays light in a second manner to indicate that the person should presently be washing his/her hands. Many of the features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
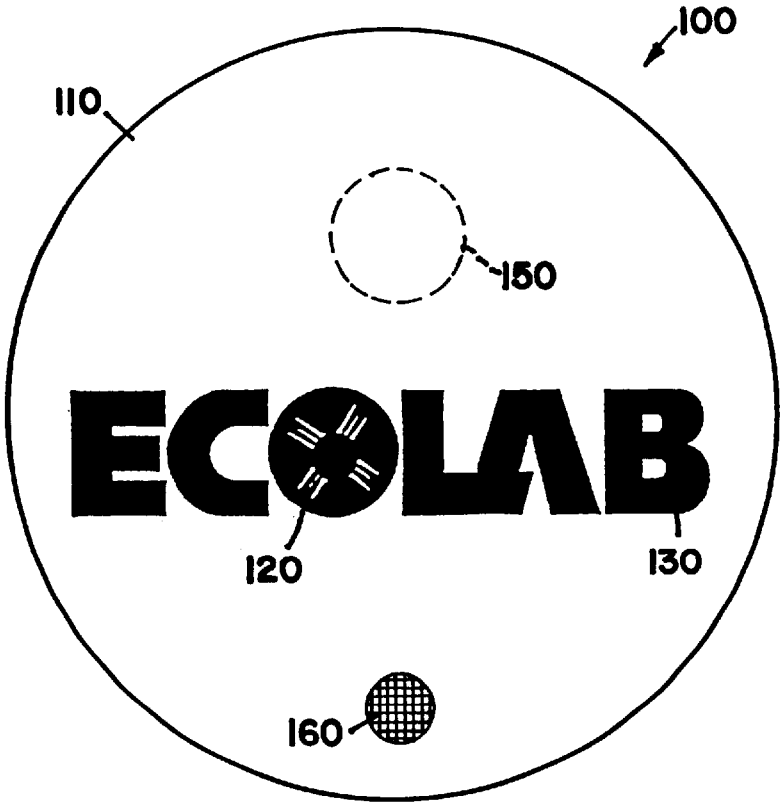
FIG. 1 is a front view of a preferred embodiment badge constructed according to the principles of the present invention.
Figure 2:
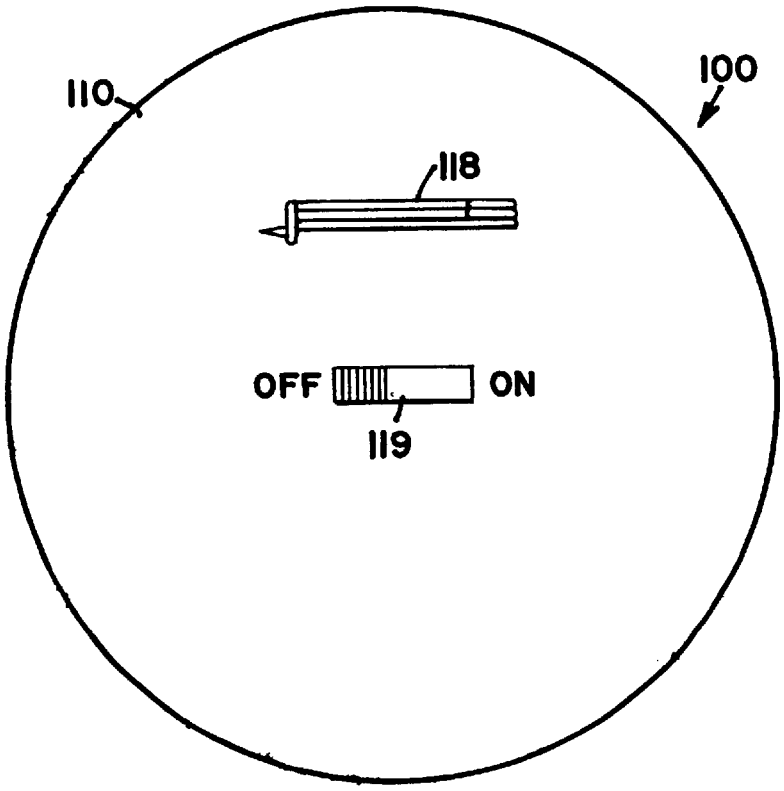
FIG. 2 is a rear view of the badge of FIG. 1.

A preferred embodiment badge constructed according to the principles of the present invention is designated as 100 in FIGS. 1–2. The badge or button 100 includes a housing or shell 110 having an opening formed therein to expose a light emitting element 120 which is preferably mounted inside. On the preferred embodiment 100, the light emitting element is an LED, but those skilled in the art will recognize that other suitable light emitting elements and/or signaling devices may be used in the alternative.

The front side of the housing 110 is flexible and spans a pressure sensitive switch disposed inside the housing. In a manner well known in the art, pressure applied against the flexible surface of the housing 110 trips the pressure sensitive switch. Those skilled in the art will recognize that the present invention is not limited to this particular type of switch, but rather, may be used with a variety of known switches, including push buttons, slides, toggles, rotary switches, or the like.

The front side of the housing 110 is also well suited for bearing promotional information (such as the company logo designated as 130) and/or information about the purpose of the badge 100. In the alternative, the front of the housing 110 may be decorated to camouflage or obscure the underlying purpose of the badge 100. In any event, such decoration and/or information is preferably secured to the housing 110 by lamination, but may be secured by other suitable means, including direct printing, silk screening, painting, embossing, or the like.

A pin type clasp 118 is provided on the rear of the housing 110 to facilitate mounting of the badge 100 to a person's clothing. Those skilled in the art will recognize that other suitable mounting means, such as a button receiving hole or an alligator clip, for example, may be substituted for the clasp 118.

A toggle switch 119 is provided on the rear side of the housing 110 to turn the badge 100 on and off. Those skilled in the art will recognize that the present invention is not limited to this particular type of switch, or to the provision of any such on/off switch, for that matter. For example, any of the switches mentioned above may be used, and/or the badge may be manufactured without any such switch. In the latter case, the badge may simply be made and distributed in a permanent "ON" mode, or it could be provided with a light sensitive device which activates and/or powers the badge when exposed to sufficient light.

The light emitting element 120 is placed in communication with a power source and a controller, both of which are preferably disposed inside the housing 110, but may alternatively be positioned on or near the housing 110. On the preferred embodiment 100, the power source is a conventional wrist-watch battery, and the controller is an integrated circuit configured to run a control program based on the flow diagram shown in FIG. 4. However, other suitable power sources and/or controllers may be used without deviating from the scope of the present invention. A hatch or access panel may be provided on the housing 110 to facilitate access to the power source and/or the controller.

Generally speaking, the light emitting element 120 remains lit the majority of the time the badge 100 is in use (and any power switch is moved to the "ON" position). The illuminated badge 100 indicates that the person wearing the badge 100 is in compliance with a hygiene program. At the end of a prescribed period of time, the light emitting element 120 is deactivated to signal that the person wearing the badge 100 should proceed to wash his/her hands.

Although not essential to practice the present invention, a sound emitting element may be added to the badge, as well, to audibly signal the end of the "clean hands" period and/or the end of the "wash hands" period. For example, a short "beep" (lasting one second) may indicate the end of the first period, and a longer "beep" (lasting three seconds) may indicate the end of the second period. Other beep durations and/or sequences of beeps may be used without departing from the scope of the present invention.

Figure 3:
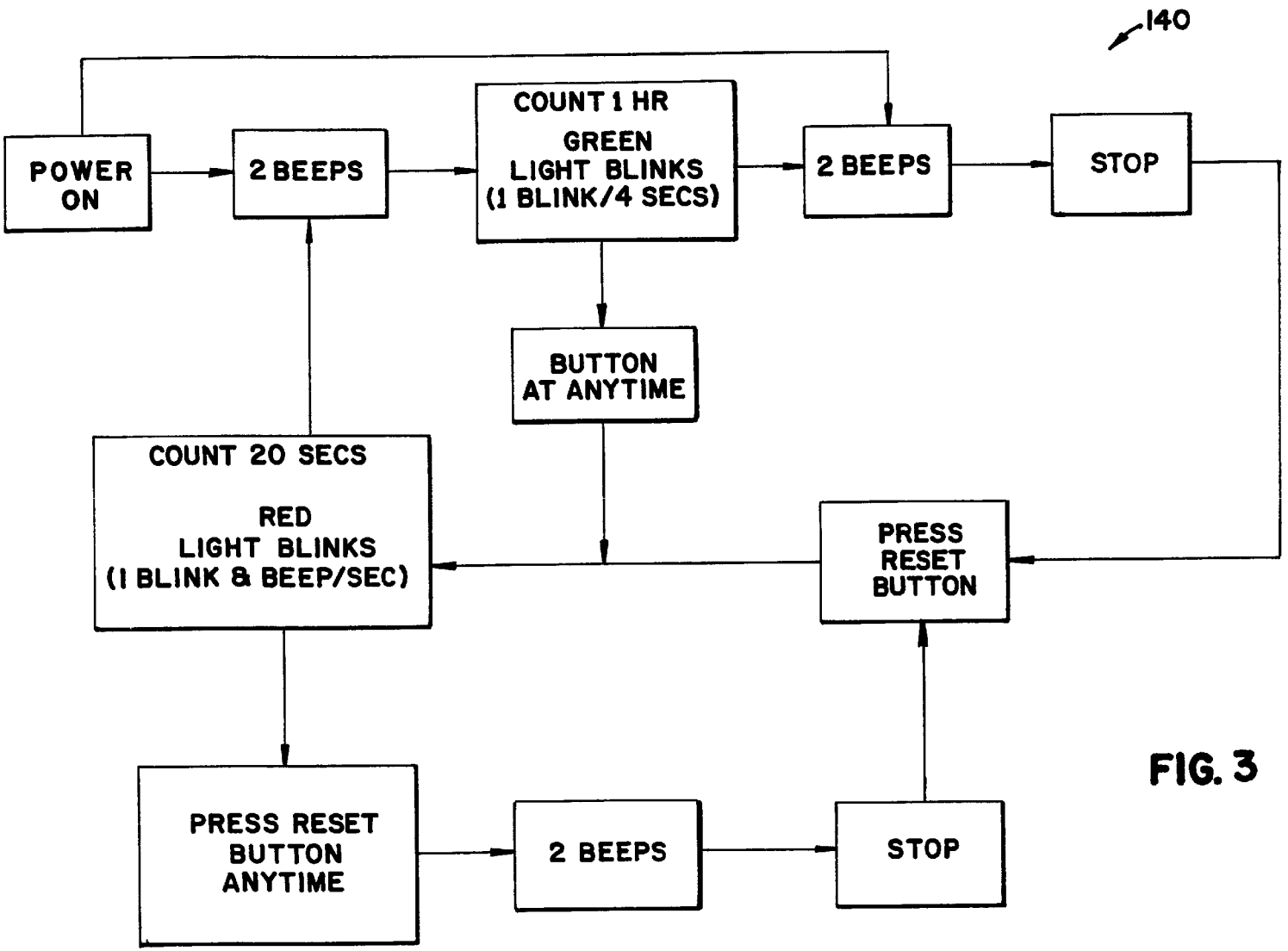
FIG. 3 is a flow chart of a preferred program that controls the operation of the badge of FIG. 1.

FIG. 3 shows a flow diagram for a preferred method of controlling the light emitting element 120 (and an optional sound generating element), once the badge 100 is active. This program 140 may be implemented by means of integrated circuit hardware and/or software. Upon initial activation, the badge 100 beeps twice and waits (without having illuminated the light emitting element 120). Upon receiving a signal from the reset button (the pressure sensitive switch on the preferred embodiment 100), the program 140 causes the light emitting element 120 to blink red at one second intervals, and the sound generating element to beep at one second intervals, both for a period of twenty seconds. If the reset button is pushed during this twenty second period, then the button beeps twice, discontinues any illumination of the light emitting element 120, and waits for the reset button to be pushed again. Twenty seconds is generally considered an appropriate length of time for a person to adequately wash his/her hands, but blinking periods of different durations may be implemented as desired or necessary for a particular application.

At the conclusion of an uninterrupted, red blinking period, the program 140 causes the sound generating element to beep twice, and then causes the light emitting element 120 to blink green at four second intervals for a period of at least thirty minutes or a period of one hour. If the reset button is pushed during this one hour period, then the program 120 returns to the red blinking stage. At the conclusion of an uninterrupted, green blinking period, the program 140 causes the sound generating element to beep twice, discontinues any illumination of the light emitting element 120, and waits for the reset button to be pushed.

In view of the foregoing, if a supervisor notices a continuously green blinking badge 100, he/she presumes that the person wearing the badge 100 has clean hands. If a supervisor notices an unlit badge 100, he/she knows that the person wearing the badge 100 should proceed to wash his/her hands. And, if the person's supervisor notices a red blinking badge 100 outside the wash area, he/she knows that the person wearing the badge 100 is not complying with the program.

Figure 4:
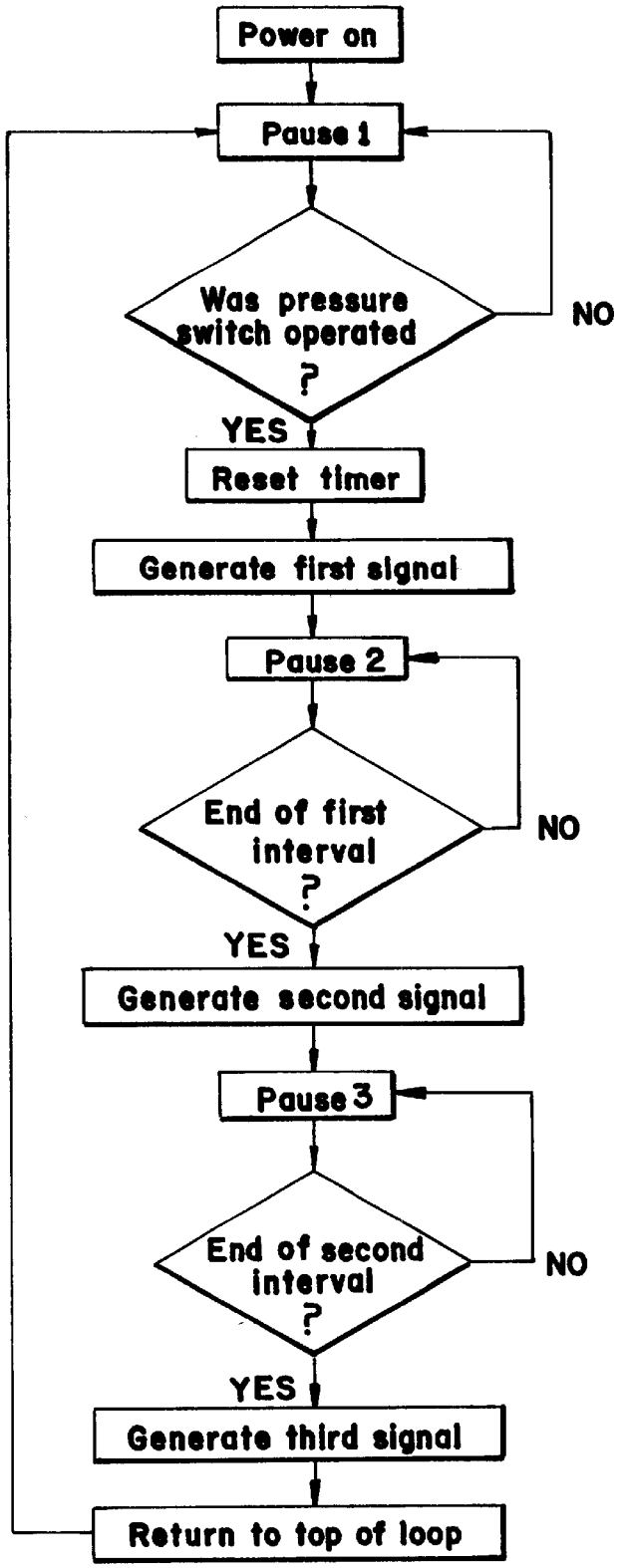
FIG. 4 is a flow chart of an alternative program suitable for controlling the operation of the badge of FIG. 1.

FIG. 4 shows an alternative control program 150 which is also suitable for monitoring input and controlling output associated with the badge 100. After the switch 119 is moved to the "ON" position (assuming such a switch is provided), the control program may cause the light emitting element 120 to generate a unique signal (such as blinking on and off), indicative of the switch 119 being moved to the "ON" position and/or reminding the person wearing the badge 100 to wash his/her hands at the beginning of a shift. This optional step is not shown in FIG. 4. Depending on how the remainder of the control program operates, this unique signal might discourage people from simply turning their buttons off and on, instead of washing their hands.

After a first pause period, the program tests to determine whether the pressure sensitive switch (or other triggering device) has been tripped. If not, then the program continues to repeat the first pause period and the same switch test until the switch is tripped. Once the switch is tripped, the program resets its internal timer and generates a first signal, preferably causing the light emitting element 120 to blink on and off. At this stage in the program, the person wearing the badge 100 should be washing his/her hands. In other words, the person wearing the badge 100 should only squeeze the badge 100 (to trip the pressure sensitive switch) when he/she is in a wash area and about to wash his/her hands. In accordance with the control program, the light emitting element 120 continues to generate the first signal until twenty seconds, or another desired interval of time, has elapsed.

The program repeats a second pause loop until the first interval of time has elapsed, and then the program generates a second signal, preferably causing the light emitting element 120 to remain continuously illuminated. At this stage in the program, the person's hands were presumably recently washed and are considered clean. The program then repeats a third pause loop, while the light emitting element 120 remains illuminated, until a second prescribed interval of time, preferably sixty minutes, has elapsed.

At the conclusion of the second interval of time, the program generates a third signal, preferably deactivating the light emitting element 120. At this stage in the program, the person is supposed to proceed to wash his/her hands. The program then returns to the first pause loop, and the light emitting element 120 remains deactivated until the program detects that the pressure sensitive switch has been tripped again.

Based on the foregoing program shown in FIG. 4, if a supervisor notices a continuously illuminated badge 100, he/she presumes that the person wearing the badge 100 has clean hands. If a supervisor notices an unlit badge 100, he/she knows that the person wearing the badge 100 should proceed to wash his/her hands. And, if the person's supervisor notices a blinking badge 100 outside the wash area, he/she knows that the person wearing the badge 100 is not complying with the program.

The foregoing description and accompanying figures disclose a preferred embodiment badge 100 suitable for promoting hygiene, together with some optional features and/or alternative components. However, it is to be understood that the foregoing disclosure may lead those skilled in the art to recognize additional variations which are not specifically disclosed herein, but which nonetheless incorporate the essence of the present invention. Accordingly, the scope of the present invention is to be limited only to the extent of the following claims.

What is claimed is:

1. A method of encouraging a person to practice hygiene, comprising the steps of:

providing a badge adapted to be worn by the person;

providing a light emitting element on the badge;

activating the light emitting element;

providing a timer on the badge to deactivate the light emitting element only after a pre-programmed interval of time has elapsed; and encouraging the person to wash his/her hands upon deactivation of the light emitting element.

2. The method of claim 1, further comprising the step of encouraging the person to wear the badge.

3. The method of claim 1, further comprising the step of providing a switch on the badge to allow the person to contemporaneously start the timer and activate the light emitting element, wherein the light emitting element is deactivated only after the pre-programmed interval of time has elapsed since the switch was last operated.

4. The method of claim 3, further comprising the step of encouraging the person to operate the switch in anticipation of washing his/her hands.

5. The method of claim 1, further comprising the steps of providing a sound emitting element on the badge; and activating the sound emitting element upon deactivation of the light emitting element.

6. The method of claim 5, wherein the sound emitting element emits sound for approximately two seconds upon deactivation of the light emitting element.

7. The method of claim 5, wherein the sound emitting element emits a first sound upon operation of the switch, and the sound emitting element emits a second sound after a relatively shorter, second pre-programmed interval of time has elapsed since the switch was last operated.

8. The method of claim 1, wherein the light emitting element emits pulses of red light during the pre-programmed interval of time.

9. The method of claim 1, wherein the light emitting element emits light in a first way during a first portion of the pre-programmed interval of time, and the light emitting element emits light in a second way during a second portion of the pre-programmed interval of time, and the person is encouraged to wash his/her hands throughout the first portion of the pre-programmed interval of time.

10. The method of claim 9, wherein the first portion of the pre-programmed interval of time is twenty seconds, and the second portion of the pre-programmed interval of time is sixty minutes.

11. The method of claim 9, wherein the light emitting element emits pulses of light during the first portion of the pre-programmed interval of time, and the light emitting element emits uninterrupted light during the second portion of the pre-programmed interval of time.

12. The method of claim 11, wherein the first portion of the pre-programmed interval of time is less than one minute, and the second portion of the pre-programmed interval of time is at least thirty minutes.

13. The method of claim 1, wherein the badge is provided with graphics directed toward consumers who interact with the person wearing the button.

14. A method of supervising a person to encourage practice of good hygiene, comprising the steps of:

providing a badge adapted to be worn by the person;

providing a light emitting element on the badge;

providing a switch on the badge to allow the person to selectively activate the light emitting element;

operating the light emitting element in a first mode for a first preprogrammed time interval;

operating the light emitting element in a second, visibly discrete mode for a subsequent, second pre-programmed time interval;

providing a tiner on the badge to deactivate the light emitting element upon termination of the second pre-programmed time interval; and encouraging the person to wear the badge; approach a wash area upon deactivation of the light emitting element; operate the switch to activate the light emitting element; and wash his/her hands throughout the first pre-programmed time interval, whereby the first mode should be visible only in the wash area.

15. The method of claim 14, wherein the first pre-programmed time interval is less than one minute, and the second pre-programmed time interval is at least thirty minutes.

16. The method of claim 15, wherein the first pre-programmed time interval is twenty seconds, and the second pre-programmed time interval is sixty minutes.

17. The method of claim 14, wherein the light emitting element emits pulses of red light in the second mode.

18. The method of claim 17, wherein the light emitting element emits pulses of green light in the first mode.

19. The method of claim 14, wherein the light emitting element emits pulses of green light in the first mode.

20. A badge, comprising:

a base;

a power source on the base;

a light emitting element on the base;

a switch on the base;

a controller on the base, wherein the controller causes the light emitting element to illuminate in a first way for a first prescribed period of time which is at least thirty minutes, and then to appear unlit until the switch is operated, and then to illuminate in a second way for a second prescribed period of time which is less than one minute.

* * * * *